US005375810A

United States Patent [19]

Mathis

[11] Patent Number: 5,375,810

[45] Date of Patent: Dec. 27, 1994

[54] FORMWORK COMPONENT

[75] Inventor: Hugo Mathis, Bregenz, Austria

[73] Assignee: Rund-Stahl-Bau Gesellschaft m.b.h, Fussach, Austria

[21] Appl. No.: 38,532

[22] Filed: Mar. 29, 1993

[30] Foreign Application Priority Data

Apr. 1, 1992 [AT] Austria ..... 658/92
Jun. 2, 1992 [AT] Austria ..... 1136/92

[51] Int. Cl.[5] ..... E04G 9/02; E04G 11/04

[52] U.S. Cl. ..... 249/192; 249/44; 249/47; 249/165; 249/166; 249/193; 249/196; 249/207; 249/210; 249/219.1

[58] Field of Search ..... 249/44, 47, 165, 166, 249/192, 193, 196, 207, 210, 219.1

[56] References Cited

U.S. PATENT DOCUMENTS

| | | | |
|---|---|---|---|
| 4,017,052 | 4/1977 | Azzaroni | 249/183 |
| 4,316,594 | 2/1982 | Schwöver | 249/18 |
| 4,579,312 | 4/1986 | White | 249/6 |
| 4,742,985 | 5/1988 | Mathis | 249/193 |
| 4,776,555 | 10/1988 | Maynard | 249/6 |
| 5,015,117 | 5/1991 | Pawlicki | 403/300 |
| 5,020,769 | 6/1991 | Botes | 249/44 |
| 5,078,360 | 1/1992 | Spera | 249/26 |
| 5,102,092 | 4/1992 | Salas | 249/192 |
| 5,125,618 | 6/1992 | Saervoll | 249/44 |
| 5,174,909 | 12/1992 | Ward | 249/44 |

FOREIGN PATENT DOCUMENTS

| | | |
|---|---|---|
| 1084790 | 1/1955 | France . |
| 2566821 | 7/1984 | France . |
| 2663356 | 12/1991 | France . |
| 3806012 | 9/1989 | Germany . |
| 7614426 | 6/1978 | Netherlands . |

*Primary Examiner*—James C. Housel
*Assistant Examiner*—Harold Y. Pyon
*Attorney, Agent, or Firm*—Friedrich Kueffner

[57] ABSTRACT

A formwork component for the erection of cast structural walls, particularly for the erection of concrete walls. The formwork components includes a formwork plate with stiffening elements, for example, frames or girders, being mounted at the rear side of the formwork plate. Rails are provided on at least two oppositely located edges of the formwork plate. When several formwork plates are located next to each other or one above the other, the rails are located next to each other. The rails are connected by connecting elements, such as screws, clamps, or braces. Positioning, elements are provided on the rails. The positioning elements are projections and abutments which receive the projections and have a shape corresponding to that of projections.

12 Claims, 4 Drawing Sheets

Fig. 13
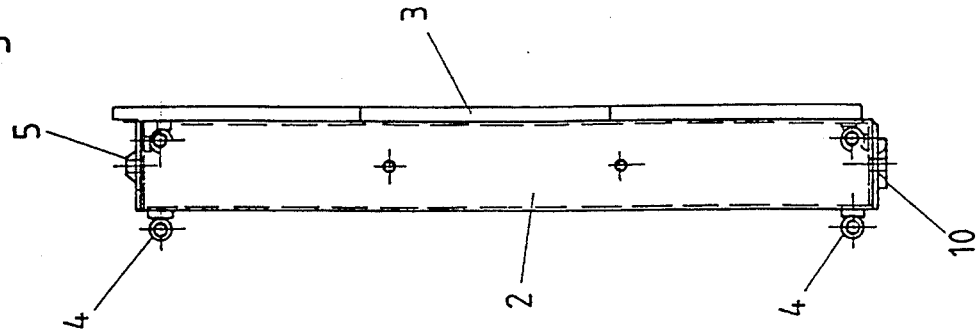
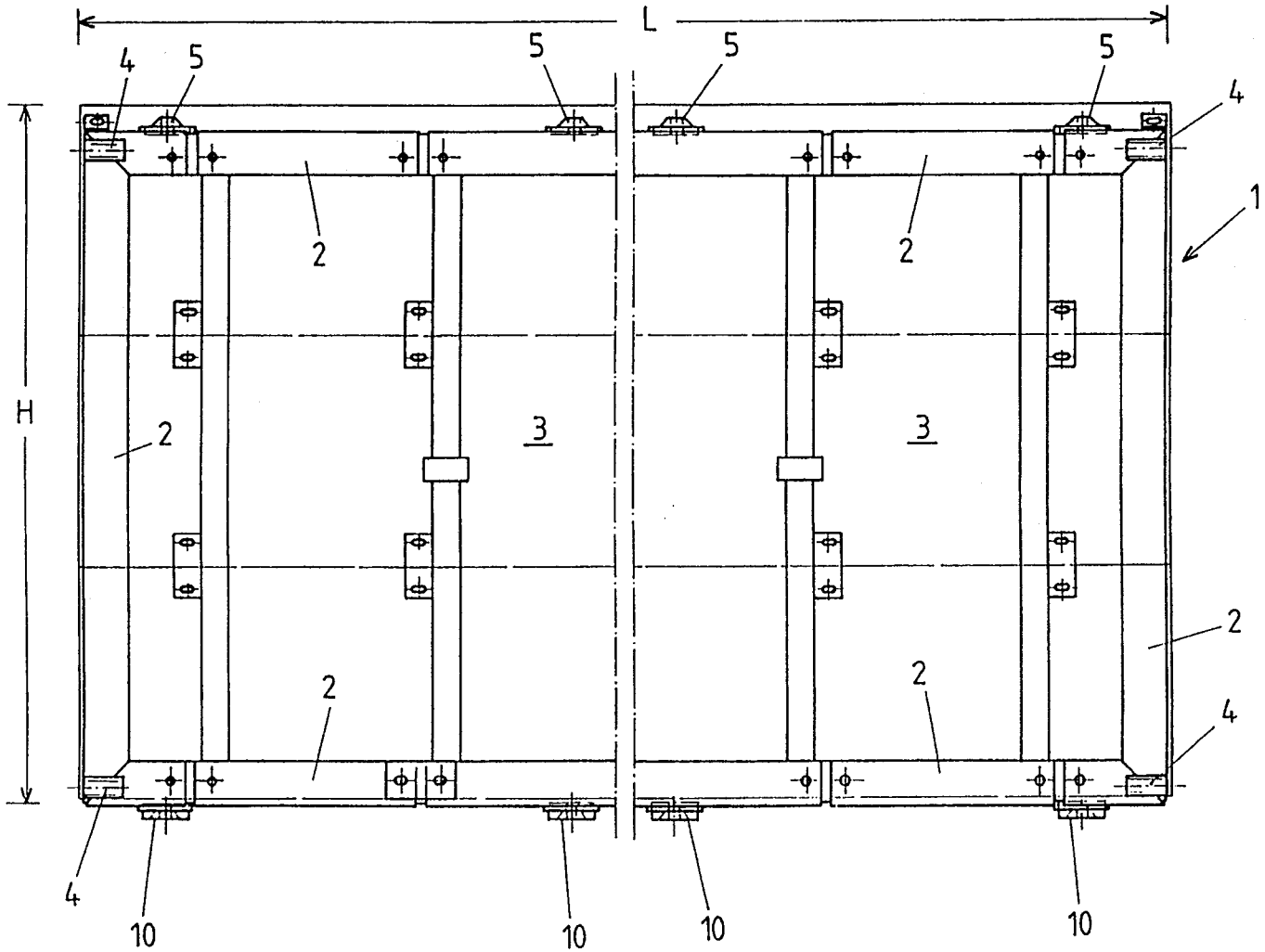
Fig. 12

FORMWORK COMPONENT

BACKGROUND OF THE INVENTION

1. The present invention relates to a formwork component for erecting cast structural walls, particularly for erecting concrete walls. The formwork component includes a formwork plate member and stiffening elements, for example, frames or girders, mounted on the rear side of the formwork plate member. Rails are provided on at least two oppositely located edges of the formwork plate member. When two or more formwork components are mounted one above the other or next to each other, the rails of adjacent structural components are located next to each other and serve to receive connecting elements, such as screws, clamps, or braces.

2. Description of the Related Art

Formwork components of the above-described type are known in the art. These components are used in the erection of large buildings and have substantial dimensions. For example, such formwork components may have a length of 3 meters and a height of 1.5 meters and, therefore, have a substantial weight. They can only be manipulated by means of lifting equipment. Formwork components of this type are combined to form large surfaces by placing them next to each other and above each other and connecting them by means of screws, bolts, and/or wedges in a frictionally engaging and positively engaging manner. It is difficult to exactly position these formwork components when placing them above each other for forming a formwork. Accordingly, it is already known in the art to provide wedge-shaped intermediate pieces which are placed in such a way that a formwork component which is to be placed on top of another formwork component can be moved at a right angle relative to the formwork surface in order to adjust the distance from the formwork surface and to avoid the formation of steps within the formwork surface.

SUMMARY OF THE INVENTION

Therefore, it is the primary object of the present invention to provide a formwork component of the above-described type which can be exactly aligned relative to other formwork components to which it is to be connected, without requiring complicated structural features.

In accordance with the present invention, the rails mounted on the formwork component include positioning elements in the form of projections which project from the rails and abutments for receiving the projections, wherein the abutments and the projections are shaped so as to correspond to each other.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWING

In the drawing:

FIG. 12 is an elevational view of another embodiment of the formwork component according to the present invention;

FIG. 13 is a side view of the formwork component of FIG. 12;

DESCRIPTION OF THE PREFERRED EMBODIMENTS

Figure 1:
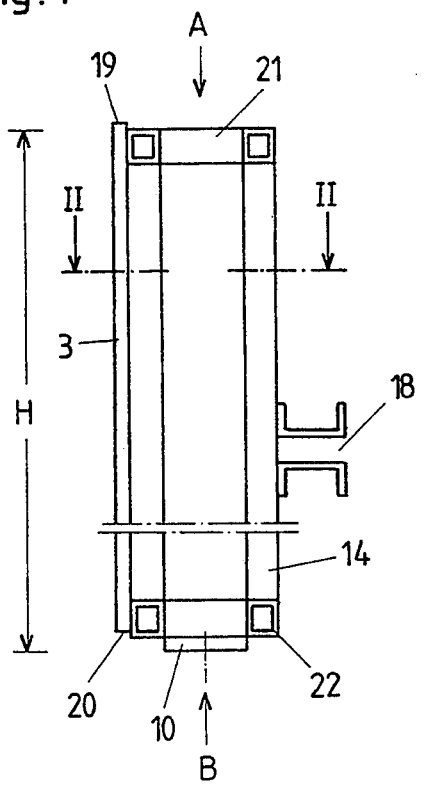
FIG. 1 is a schematic side view of a formwork component according to the present invention.
Figure 6:
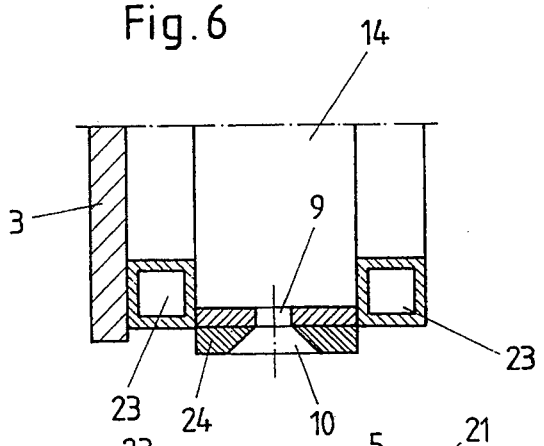
FIG. 6 is a sectional view, on a larger scale, taken along sectional line VI—VI of FIG. 4.

FIG. 1 of the drawing shows a formwork component according to the present invention with a formwork plate 3 which may be formed, for example, by a laminated wood plate. A plurality of parallel I-beams 14 are mounted on the rear side of the formwork plate 3. The I-beams 14 are, for example, formwork girders which may be manufactured of wood. Each I-beam 14 has an upper flange 15 and a lower flange 16 and a web 17 extending between the flanges. The components forming the I-beam 14 are glued together in the conventional manner. Wall tie beams 18 of channel sections are used for stiffening.

Figure 5:
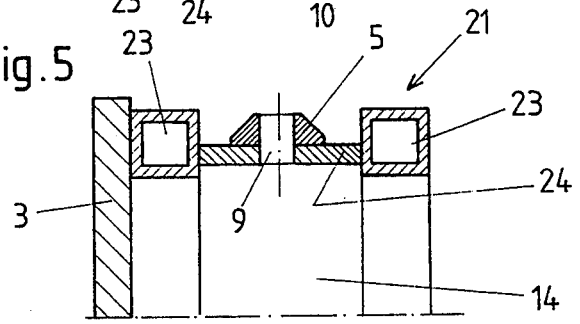
FIG. 5 is a cross-sectional view, on a larger scale, taken along sectional line V—V of FIG. 3.
Figure 2:
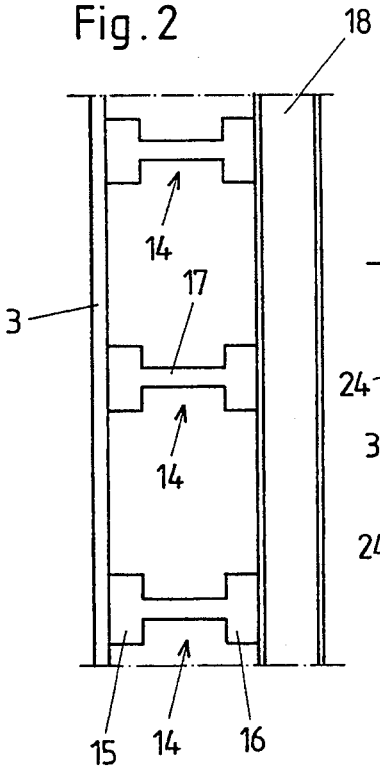
FIG. 2 is a horizontal sectional view taken along sectional line II—II of FIG. 1.
Figure 3:
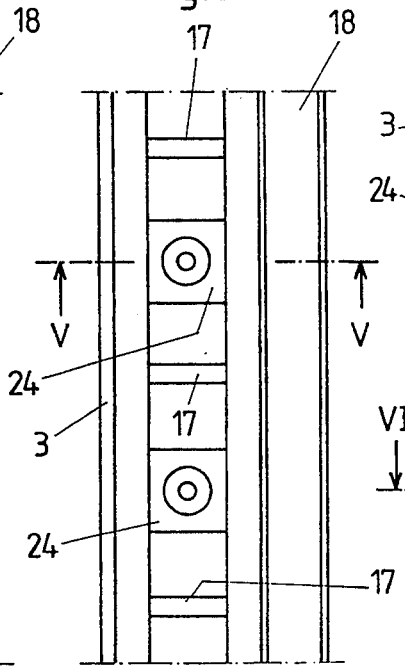
FIG. 3 is a schematic top view of the formwork component seen in the direction of arrow A of FIG. 4.
Figure 4:
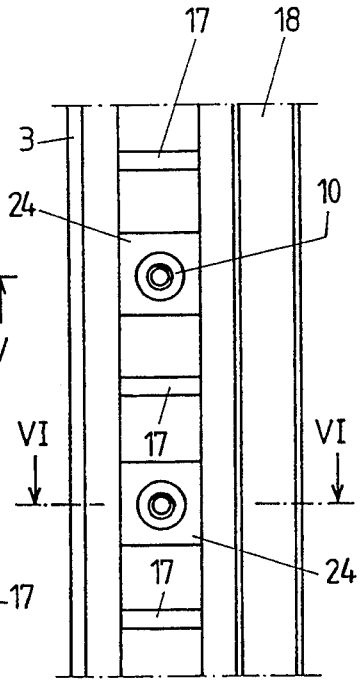
FIG. 4 is a bottom view of the formwork component seen in the direction of arrow B of FIG. 1.

The I-beams 14 are slightly shorter than the height H of the formwork plate 3 and are arranged relative to the formwork plate 3 in such a way that the two end faces thereof are slightly recessed relative to the edges 19, 20 of the formwork plate 3. The space defined by the edges 19, 20 and the end faces of the I-beam 14 is occupied by so-called stacking rails 21, 22. In the illustrated embodiment, the rails 21, 22 are each formed of two box sections 23. Between the webs 17 of the I-beams 14, the box sections 23 of the upper stacking rail 21 are connected to each other by means of connecting webs 24. The connecting webs 24 support a truncated cone-shaped projection 5 which has a central bore 9, as illustrated in FIG. 5 of the drawing. The angle defined by the conical portion of the truncated cone-shaped projection is approximately 90°. The truncated cone-shaped projection is arranged in such a way that it is located between the box sections 23.

The box sections 23 of the lower stacking rail 22 are also connected to each other by means of connecting webs 24, similar to the box sections of the upper stacking rail 21. The connecting webs 24 support a bushing 10 with a conical interior constructed corresponding to the truncated cone-shape of the projection 5.

In the embodiment of the formwork component illustrated in FIG. 5, the projections and abutments are provided at the upper and lower edges of the component, respectively. Of course, it is within the scope of the invention to provide corresponding projections and abutments at all four edges of the formwork components.

When formwork components of the above-described type are mounted together to construct a formwork, the truncated cone-shaped projections and the bushings with the conical interiors engage in each other in a positively fitting manner and position the formwork components to be connected in longitudinal direction as well as in transverse direction. As a result, placement of the formwork components and the construction of an entire formwork from such formwork components are substantially simplified. After the formwork components have been positioned relative to each other, fastening screws are inserted in bores 9, 13 of the positioning elements.

Instead of conically shaped positioning elements, it is basically also possible to use elements having a cylindrical shape. However, at least one of the two parts serving for positioning should have a beveled or conically shaped edge zone, so that the parts serving for positioning can be easily inserted into each other when the framework components are placed.

Figure 7:
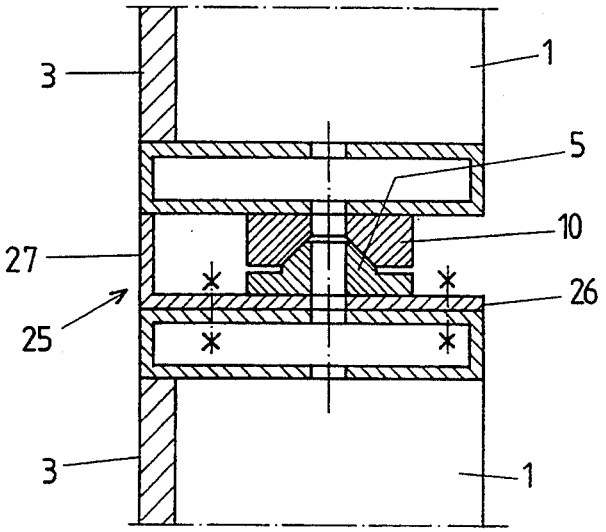
FIG. 7 is a schematic sectional view of a detail of the edge portions of two formwork components of a different type mounted on each other.
Figure 9:
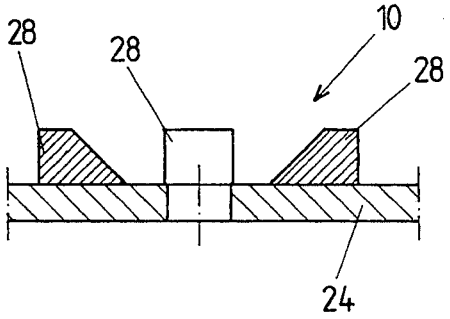
FIG. 9 is a sectional view taken along sectional line IX—IX in FIG. 8.
Figure 11:
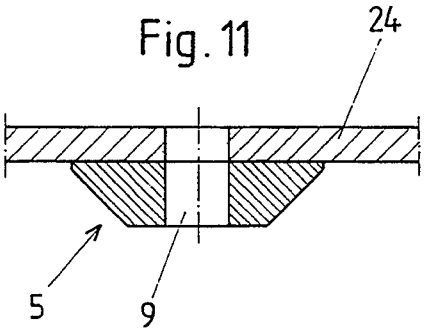
FIG. 11 is a sectional view taken along sectional line XI—XI of FIG. 10.
Figure 8:
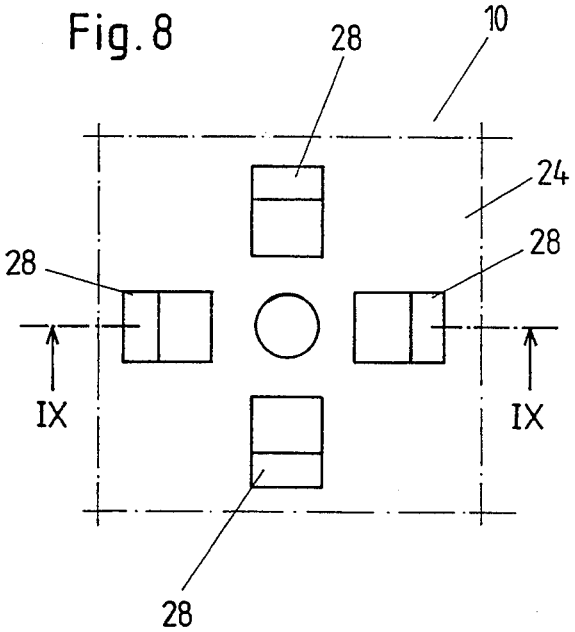
FIG. 8 is a top view of another embodiment of an abutment.
Figure 10:
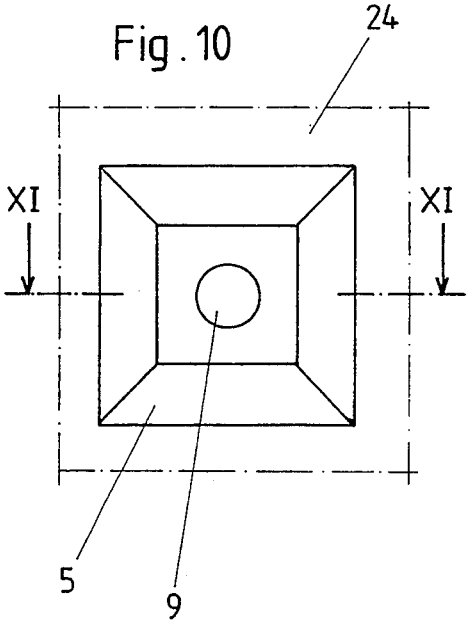
FIG. 10 is a top view of a projection corresponding to the abutment of FIG. 8.

FIG. 7 of the drawing shows another embodiment of the formwork component according to the present invention. As shown in FIG. 7, two formwork components are placed on top of each other. The formwork plate 3 of this formwork component is formed by a frame 1 in the form of a box section. FIG. 7 shows how formwork components which may already be in use can be equipped subsequently with positioning elements according to the present invention. Thus, the projection 5 is arranged on a side 26 of a L-shaped sectional rail 25, wherein this side 26 supporting the projection 5 is connected to a rail member at the edge of the formwork component. The outer surface of the other side 27 of the L-shaped sectional rail 25 is arranged so as to be flush with the outer surface of the formwork plate 3 which forms the formwork surface. The frames 1 of the structural components of the embodiment of FIG. 7 are constructed as box sections. In addition, FIG. 7 shows that the height of the side 27 of the L-shaped sectional rail 25 which is flush with the outer surface of the formwork plate 3, corresponds approximately to the height of the projection 5 or is slightly greater than the height of the projection 5.

In the embodiments discussed above, the positioning elements are truncated cone-shaped projections and bushings with conically hollow interiors. The projections and bushings are constructed so as to correspond to each other. It is within the scope of the invention to provide truncated pyramid-shaped projections and hollow pyramids as the abutments or bushings.

Also, in the embodiments described above, the abutment or bushing is constructed so as to be circumferentially closed. It is possible to divide the abutment or bushing into individual sectors in circumferential direction and to provide intermediate spaces between these sectors, so that the projections inserted in the abutments do not rest against the entire circumference of an abutment surface, but only along individual sectors. This configuration of the abutment or bushing is provided in order to facilitate cleaning of the abutment or bushing when concrete should accumulate in the abutment or bushing. An embodiment of this type is illustrated in FIGS. 8–11. As shown in FIGS. 8–11, the projection 5 is truncated pyramid-shaped, and the abutment 10 receiving the projection 5 is formed by four conically shaped locks 28.

FIG. 12 is a rear view of another embodiment of the formwork component according to the present invention. This formwork component has a circumferentially closed, rectangular frame 1 composed of U-shaped sectional rails or channel sections 2. The channel sections forming the frame are arranged in such a way that the open sides thereof face each other. A formwork component of this type may have a length of 3 meters and a height of 1.5 meters. However, the present invention is not limited to formwork components having these dimensions.

Also, the formwork component illustrated in FIGS. 12, 13 has a plane formwork surface. However, it is also possible, as will be described hereinbelow, to provide a formwork component of this type with a curved formwork surface.

The actual formwork plate 3 which forms the formwork surface is fastened to the front of the frame. This formwork plate 3 may be of metal, wood, or plastics material, or of a combination of these materials. As is particularly clear from FIG. 13, the edges of the formwork plate 3 may be slightly offset relative to the circumferential contour of the frame 1. On the side of the frame 1 facing away from the formwork plate 3, i.e., on the rear side of the frame 1, pipe pieces 4 are welded to the comer portions of the frame. The pipe pieces 4 have horizontally extending axes and serve to receive fastening screws which are used for clamping together formwork components which are placed next to each other. In addition, the beams or channel sections forming the frame may be provided with cutouts through which fastening screws and connecting screws may be passed. However, these cutouts are not illustrated in the drawing. A plurality of projections 5 are fastened, for example, welded, to the upper horizontally extending beam of the frame 1. Specifically, the projections 5 are fastened to the side of the upper channel section 2 extending at a right angle to the formwork plate 3. The projections 5 are equally spaced from each other.

Figure 14:
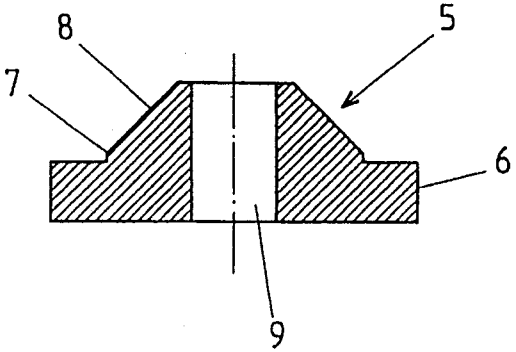
FIG. 14 is a cross-sectional view of a truncated cone-shaped projection.
Figure 15:
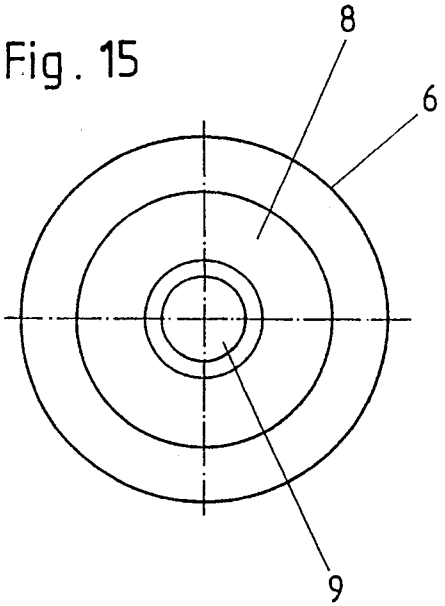
FIG. 15 is a top view of an abutment corresponding to the projection of FIG. 14.

FIGS. 14, 15 of the drawing show such a projection 5 on a larger scale in a cross-sectional view and a top view, respectively. The projection 5 shown in FIGS. 14, 15 has a circular base plate 6 which is connected, through a short cylindrical transition 7, to a truncated cone 8, wherein the angle defined by the side surfaces of the truncated cone is approximately 90°. A bore 9 extends through the center of the projection 5. The diameter at the bottom of the projection 5 is substantially greater than the height of the projection 5.

Figure 17:
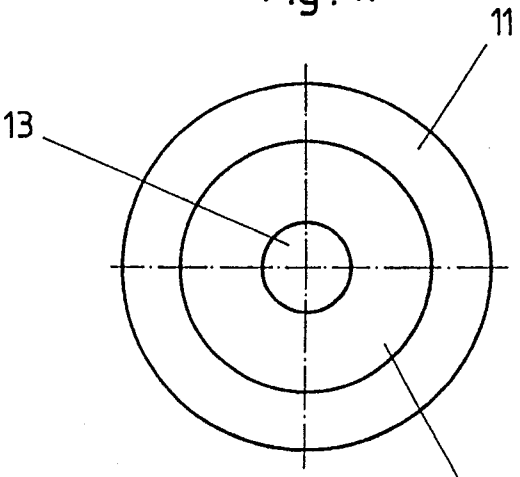
FIG. 17 is a top view of a projection corresponding to the abutment of FIG. 16.
Figure 16:
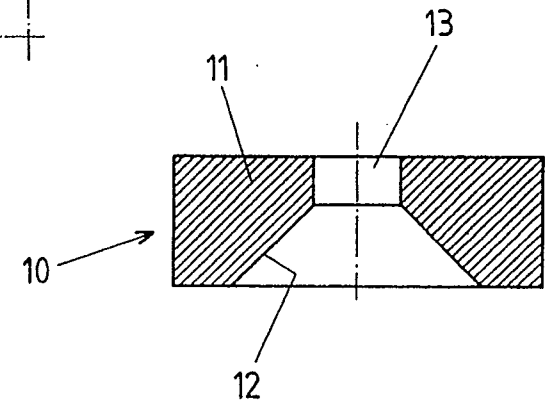
FIG. 16 is a cross-sectional view of another embodiment of the abutment.
Figure 18:
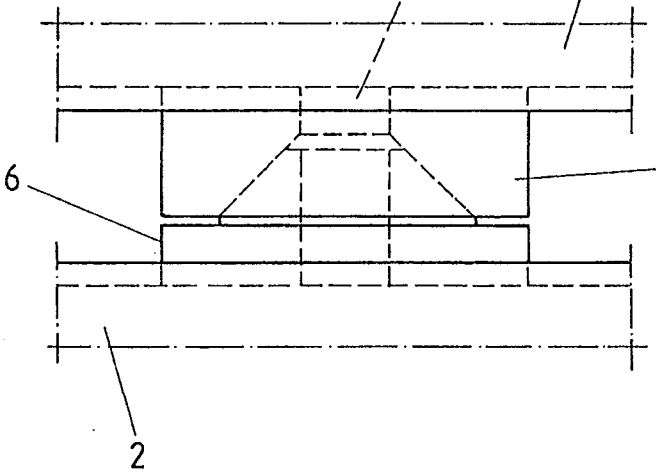
FIG. 18 is a schematic illustration of a connection between a projection and an abutment.

As described above, bushings 10 which are shaped so as to correspond to the above-described truncated cones 8 of the projections 5 are mounted on the lower horizontal beam of the frame 1. The bushings 10 are arranged so as to be located opposite the projections 5 of another formwork component. As illustrated in FIGS. 16, 17, the bushings 10 are composed of a cylindrical base portion 11 with a hollow cone 12, wherein the hollow cone 12 is connected to a cylindrical bore 13. The axes of the bore 13 and of the hollow cone 12 extend concentrically with the center axis of the cylindrical base portion 11. The truncated cones 8 and the matching hollow cones 12 are mounted so as to coincide with bores which are provided in the sides of the sectional rails 2 which support the projections and abutments. This is schematically illustrated in the detail of FIG. 18. The bores serve as openings for passing fastening screws therethrough.

In the illustrated embodiment, the positioning elements for the formwork components are arranged on the horizontally extending beams of the frame 1. Of course, it is within the scope of the invention to also arrange the positioning elements at the vertically extending beams of the frame 1.

When formwork components of the above-described type are placed in order to construct a formwork, the truncated cones 8 and the hollow cones 12 engage positively into each other and, as a result, position the formwork components to be connected in the longitudinal direction as well as in the transverse direction, so that the placing of such formwork components, or the construction of a formwork from such formwork components, is made substantially simpler.

As a rule, the projections and abutments or bushings are mounted on the outer sides of the rails. However, it is also possible to arrange the abutments or bushings on the inner sides of the rails, not shown in the drawing.

It should be understood that the preferred embodiments and examples described are for illustrative purposes only and are not to be construed as limiting the scope of the present invention which is properly delineated only in the appended claims.

I claim:

1. A formwork component for the erection of cast structural walls, the formwork component comprising a formwork plate having a rear side, stiffening elements mounted on the rear side of the formwork plate, the formwork having edges, rails being mounted at least on two oppositely located edges of the formwork plate, such that at least one of the rails is located adjacent a rail of another formwork component to be connected thereto, further comprising positioning elements mounted on the rails, the positioning elements comprising projections on one of the rails and abutments on an oppositely located rail, wherein the projections and abutments are shaped so as to form complements of each other, further comprising connecting elements for connecting adjacent rails of the formwork components, wherein each projection has a truncated cone-shape and the abutments each have a truncated cone-shaped cavity complementary to the truncated cone-shaped projections, each projection and abutment having a bore extending concentrically therethrough for receiving one of said connecting elements.

2. The formwork component according to claim 1, wherein the stiffening elements are frames.

3. The formwork component according to claim 1, wherein the stiffening elements are girders.

4. The formwork component according to claim 1, wherein each abutment is composed of individual sectors in circumferential direction thereof, and wherein intermediate spaces are provided between the sectors.

5. The formwork component according to claim 1, further comprising an L-shaped sectional rail mounted between adjacent rails of formwork components, the L-shaped sectional rail having first and second sides, wherein one of the projections and abutments is mounted on the first side of the L-shaped sectional rail, means for connecting the first side of the L-shaped sectional rail to one of the rails of the for formwork plate, wherein the second side of the L-shaped sectional rail has an outer surface, the outer surface of the second side of the L-shaped sectional rail being mounted flush with an outer surface of the formwork plate.

6. The formwork component according to claim 5, wherein an abutment connected to a projection has a height, and wherein the second side of the L-shaped sectional rail has a height which is equal to or greater than the height of the abutment with the projection.

7. A formwork component for the erection of cast structural walls, the formwork component comprising a formwork plate having a rear side, stiffening elements mounted on the rear side of the formwork plate, the formwork having edges, rails being mounted at least on two oppositely located edges of the formwork plate, such that at least one of the rails is located adjacent a rail of another formwork component to be connected thereto, further comprising positioning elements mounted on the rails, the positioning elements comprising projections on one of the rails and abutments on an oppositely located rail, wherein the projections and abutments are shaped so as to form complement of each other, further comprising connecting elements for connecting adjacent rails of the formwork components, wherein each projection has a pyramid-shape and the abutments each have a pyramid shaped cavity complementary to the pyramid-shaped projections, each projection and abutment having a bore extending concentrically therethrough for receiving one of said connecting elements.

8. The formwork component according to claim 7, wherein the stiffening elements are frames.

9. The formwork component according to claim 7, wherein the stiffening elements are girders.

10. The formwork component according to claim 7, wherein each abutment is composed of individual sectors in circumferential direction thereof, and wherein intermediate spaces are provided between the sectors.

11. The formwork component according to claim 7, further comprising an L-shaped sectional rail mounted between adjacent rails of formwork components, the L-shaped sectional rail having first and second sides, wherein one of the projections and abutments is mounted on the first side of the L-shaped sectional rail, means for connecting the first side of the L-shaped sectional rail to one of the rails of the formwork plate, wherein the second side of the L-shaped sectional rail has an outer surface, the outer surface of the second side of the L-shaped sectional rail being mounted flush with an outer surface of the formwork plate.

12. The formwork component according to claim 11, wherein an abutment connected to a projection has a height, and wherein the second side of the L-shaped sectional rail has a height which is equal to or greater than the height of the abutment with the projection.

* * * * *